US005704242A

United States Patent [19]

Caporusso et al.

[11] Patent Number: 5,704,242

[45] Date of Patent: Jan. 6, 1998

[54] UNIVERSAL RING BENDER

[75] Inventors: Alessandro Caporusso; Mario Caporusso, both of Piedimonte S. Germano, Italy

[73] Assignee: C.M.L. Costruzioni Meccaniche Liri S.R.L., Piedimonte San Germano, Italy

[21] Appl. No.: 642,266

[22] Filed: May 3, 1996

[30] Foreign Application Priority Data

May 12, 1995 [IT] Italy ..... RM95A0309

[51] Int. Cl.[6] ..... B21D 7/08

[52] U.S. Cl. ..... 72/175; 72/173; 72/444

[58] Field of Search ..... 72/173, 175, 170, 72/157, 449, 442, 444

[56] References Cited

U.S. PATENT DOCUMENTS

| | | | |
|---|---|---|---|
| 494,450 | 3/1893 | Weir | 72/175 |
| 4,164,133 | 8/1979 | Damman | 72/175 |
| 4,580,329 | 4/1986 | Bihler | 72/442 |
| 4,653,301 | 3/1987 | Meliga | 72/175 |
| 4,696,178 | 9/1987 | Bihler | 72/444 |
| 4,723,431 | 2/1988 | McKindary | 72/170 |
| 4,910,984 | 3/1990 | Young | 72/175 |
| 4,918,958 | 4/1990 | Glomb et al. | 72/175 |
| 5,271,261 | 12/1993 | Bihler | 72/444 |

FOREIGN PATENT DOCUMENTS 58-163822 9/1983 Japan .

*Primary Examiner*—Daniel C. Crane
*Attorney, Agent, or Firm*—Young & Thompson

[57] ABSTRACT

Universal pipe bender comprising a geared motor (1; 11); a box, on a working table whereof two or more pairs of hollow rotary motion drives having fixed parallel rotation axes (2, 2a; 2', 2a'; 2", 2a"; 12, 12'; 12a, 12a') intended to receive, interchangeably and integrally in rotation, in their concavity respective roller hearing mandrels (200) and to transmit to the latter rotary motion impressed by said geared motor through gears arranged in said case, and a through slide (4, 40) that can be slidingly operated and fixable in position in a through guide (4') provided in said case, on the same side where said rotary motion drives open, which traverses the fixed interaxes of said pairs of rotary motion drives, and which mounts one or more further roller hearing mandrels (5, 5'; 50, 50').

10 Claims, 4 Drawing Sheets

UNIVERSAL RING BENDER

TECHNICAL FIELD

The present invention relates to the field of ring benders.

More specifically, the present invention relates to universal ring benders.

BACKGROUND OF THE INVENTION

As is known, ring benders are machines for both the helix and spiral bending of pipes or bar irons.

They find an application, for instance, in the architectural field, as for screw stairs.

They also have an application for heat exchangers, for ornamental applications such as chandeliers or grates, furniture, aluminum bars for arcades, etcetera.

A typical product of ring benders are for instance pipe coils.

Ring benders comprise three groove rollers.

The three basic configurations of such rollers are the delta one, that is to say the triangular one with a roller the projection whereof falls in the midpoint of the interaxis between the other two; the triangular one with the projection of a roller which still falls on the interaxis between the other two, but off-center relative to them, and that in which the projection of a roller falls off the interaxis between the other two.

At least one of such rollers is a driver roller, i.e. it receives a torque for carrying out the operation, provided by an electric motor, while the other rollers, idlingly mounted, accomplish the only function of affording support, whereby they are said the pressure rollers.

The configuration with two driving rollers and one pressure roller is the most common. However, ring benders with all the three rollers that drive are in use.

The pitch of the helix is imparted by thrust rollers, also said thrusters, or adjustment rollers, or rectifier rollers, made up of lengths of rectilinear tubular bar, suitably arranged in proximity with the aforementioned driving and thrust rollers. Such adjustment rollers oblige the pipe or bar to bend itself with a determinate deviation from planarity, so impressing a helix pitch to the pipe or bar which is being bent.

Universal ring benders are those ring benders that allow pipes or bars to be bent according to not a fixed, but a variable curvature radius.

In order to have the possibility to vary the curvature radius one resorts to render the mutual positioning of the rollers variable, i.e. these present variable interaxes. In fact it is the interaxis of the rollers that establishes to which measure the rectilinear pipe or bar will be bent. The more reduced the interaxis of the roller, the more reduced the curvature radius. The greater the interaxis between the rollers, the greater the curvature radius.

The linear displacement of the rollers to achieve the variation of the interaxis is obtained by displacement of one or more rollers relative to the others. For instance a roller can be displaced along a linear guide under an electric drive. The variation is also provided between two rollers through the displacement thereof by rotation of their support mandrels around a compass.

These solutions present various and serious drawbacks.

The universal ring benders that follow such solutions are very heavy, cumbersome and expensive, each driving roller having its own drive electric motor.

The variableness of the interaxes renders the structure of the ring bender not perfectly rigid, and really shows itself quite limited.

Moreover, to change the rollers as a function of the size of the pipe to be ring bent it would be necessary to proceed to long disassembly and reassembly operations, that heretofore it has been more practical to have several ring benders at disposal for various fields of sizes of pipe to be ring bent.

To have the possibility to vary the curvature radius one has also resorted to a discrete adjustment of the interaxes providing the assembly of two rollers upon respective roller bearing blocks having slots for the bolting of the supports of the two rollers with securing screws in correspondence with narrow interaxis, medium interaxis and large interaxis positions.

This solution presents the drawback of affording a very limited possibility of variation, and, moreover, that it is necessary to proceed to disassembly and reassembly operations that take a lot of time and require the intervention of a specialized operator.

OBJECTS, CHARACTERISTICS AND ADVANTAGES OF THE INVENTION

An object of the present invention is to obviate all these drawbacks, i.e. to provide a universal ring bender which is compact, cheap, rigid, and that lends itself to its utilization with any pipe size.

Another object of the present invention is to provide such a universal bender, that is, moreover, of a simple construction, and that doesn't require the intervention of a specialized operator for its use.

Such objects are achieved according to the teaching of the present invention by providing for a universal ring bender a construction with a gear case that takes a torque from a single geared motor, which torque is delivered, through the gears, to two or more pairs of rotary motion drives with fixed parallel rotation axes, that face a side of the case, intended to receive in their concavity interchangeably and integrally in rotation respective roller bearing mandrels and to transmit to the latter the rotary motion impressed thereto by the geared motor through the gears.

In a through guide, i.e. a guide from one side to the other, provided on the gear case, on the same face where the rotary motion drives open, a through slide is provided slidingly driven and fixable in position, and that supports one or more further roller bearing mandrels.

The operator mounts two rollers through respective mandrels upon two of the aforesaid motion drives rotating in the same sense in the machine case, and the third roller, necessary for the formation of the due triad of rollers, on a roller bearing mandrel on the through slide.

It is the contrivance of providing the rotary motion drives on the face of the case of the head of the ring bender that allows the interchangeability of rollers and pairs of motion drives, as there aren't projections that impede it.

The present invention, besides overcoming all the drawbacks cited above of prior art ring benders, offers the further advantage that with it the operator is able to ring bend the pipe on his same side or the opposite side, according to how it is more convenient for carrying out the operation, as he can mount the third roller on his same side or on the opposite side relative to the interaxis of the other two rollers.

Another advantage relates to the fabrication of the machine.

In prior art ring benders, the mandrels go to be integral portion of the machine. They must provide a ledge manufactured integrally with them for the roller they mount, the fabrication whereof is a further machining.

In the ring bender of the present invention the cones slightly project from the working plane of the machine case, and it is their top itself that goes to offer a rest ledge for the roller, which encounters the ledge when the conical clutch of the mandrel inserts itself into the cone of the motion drive.

Moreover, it turns out to be of a simple and cheap construction, and, moreover, utilizeable by an operator not specifically prepared for its use.

For the interchange of the rollers in fact it is enough to unscrew the lower bolt for tightening the mandrel to the cone and to substitute, an easy and immediate operation.

SUBJECT OF THE INVENTION

Therefore, the subject of the present invention is a universal ring bender characterized in that it comprises a geared motor;

a case on a working table whereof two or more pairs of hollow rotary motion drives having fixed parallel rotation axes open, intended to receive, interchangeably and integrally in rotation in their concavity, respective roller bearing mandrels and to transmit to the latter rotary motion imparted thereto by said geared motor through gears arranged in said case, and a through slide that can be slidingly operated and fixable in position in a through guide provided in the case, on the same side where the rotary motion drives open, which traverses the fixed interaxes of the pairs of rotary motion drives, and which mounts one or more further roller bearing mandrels.

It is the subject of the present invention a universal ring bender as set forth, wherein the pairs of rotary motion drives are provided with their rotation axes fixed in a same common plane.

It is in particular foreseen that three pairs of rotary motion drives are provided.

It is, moreover, foreseen that the pairs of rotary motion drives are provided with their rotation axes being fixed on staggered planes.

It is provided that two roller bearing mandrels are provided, the one on a side, the other on the other side relative to the input of said geared motor in the case.

It is provided that one of the roller bearing mandrels provided on the slide is arranged eccentric on a plate fixable in angular position on the through slide itself.

According to a preferred embodiment of the present invention, the roller bearing mandrel on the slide is motored by connection to the geared motor through a Cardan joint.

According to a particularly preferred embodiment of the present invention, the motion drives are each one made up of a mandrel conical shell cone with their concavity projectingly facing on the working table of the case, which takes its motion through a toothing provided on it from the geared motor, and that is endowed with a screwing means, accessible from the side of the case opposite the working one, for axially fixing a roller bearing mandrel to it.

It is particularly foreseen that the cones are endowed with an axial groove for their keying with the roller bearing mandrel itself to render it more safely integral to itself in rotation.

It is, moreover, the subject of the present invention, a universal ring bender as set forth heretofore, further comprising a means for mounting an adjustable position pressure counter-roller.

BRIEF DISCLOSURE OF THE DRAWINGS

The present invention will be best understood based upon the following detailed disclosure of its preferred embodiments, given only as a matter of example, absolutely not of restriction, with reference to the annexed drawings, wherein.

DESCRIPTION OF THE PREFERRED EMBODIMENTS

Figure 1:
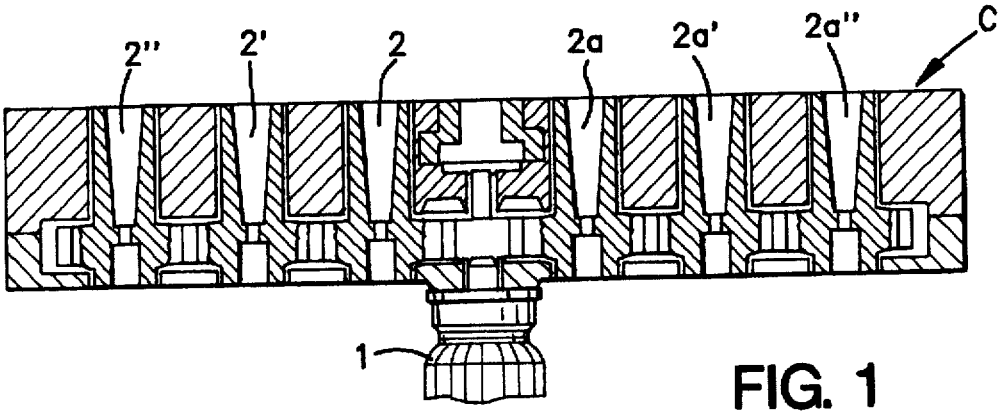
FIG. 1 is a normal section view of the bending head of a universal ring bender according to a first embodiment of the present invention.

As is seen from FIG. 1, the universal ring bender according to the present invention comprises a single electric motor which transmits its torque through a gear 1. The ring bending head is made up of a case C on a face whereof three pairs open of hollow cones or conic shells, hereinafter briefly said "cones", making up rotary motion hollow drives with fixed and parallel axes for the mounting in their concavity of respective roller bearing mandrels interchangeably and integrally in rotation. It is to be remarked that the cones are only an example of rotary motion hollow drives, and many other shapes of hollow drives can be contemplated, as for instance having a hexagonal cross-section, though still having a conicalness. The cones take motion from the geared motor 1, and are indicated respectively 2, 2*a*; 2', 2*a*' and 2*a*". Respective roller bearing mandrels for the driving rollers can be installed thereupon.

Figure 2:
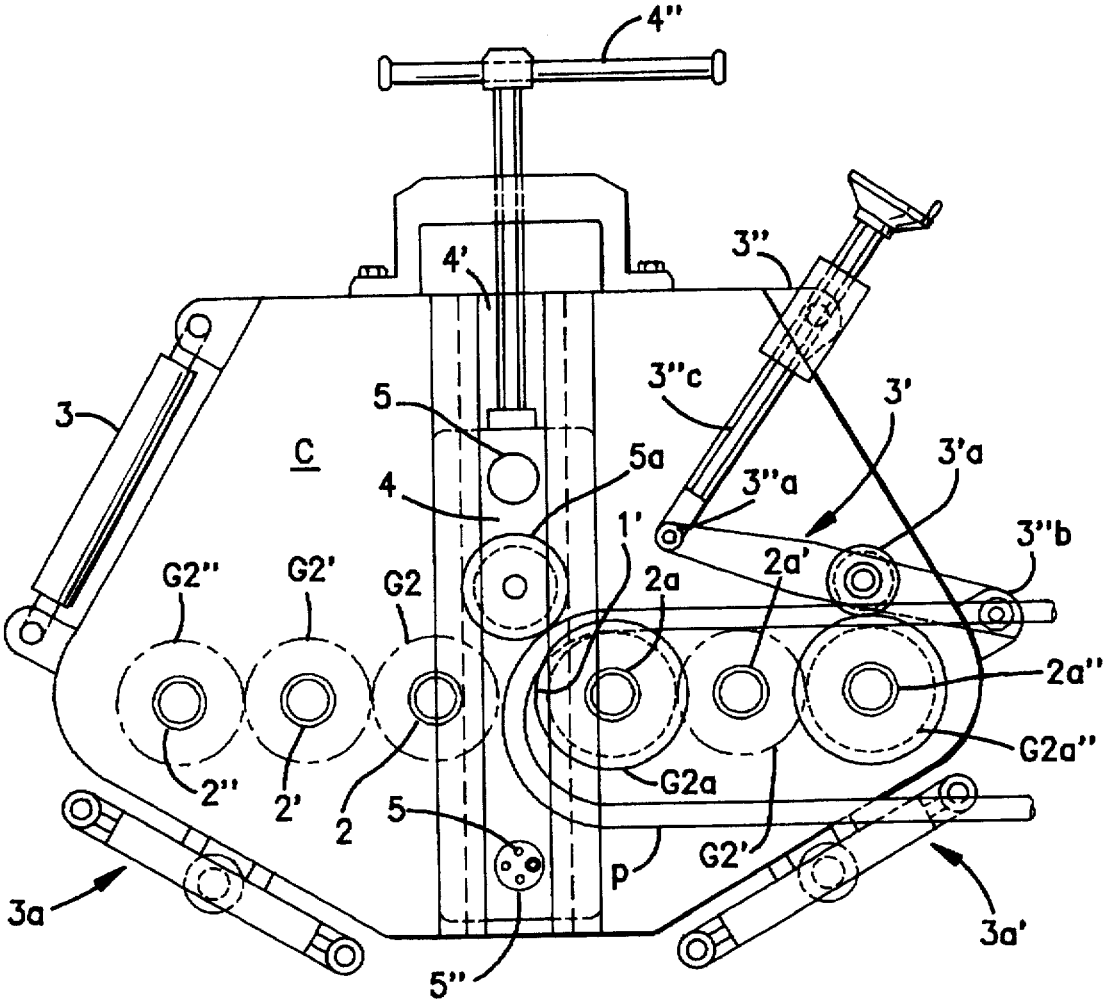
FIG. 2 is a top view of the same.

As is seen from FIG. 2, the ring bending head is completed by adjustment rollers or thrusters 3, 3*a*, 3*a*' mounted on the sides of the case.

The ring bending head of the present invention comprises, moreover, a slide 4 that moves itself shiftingly back and forth in a through guide 4', perpendicularly to the axes of the cones for mounting the roller bearing mandrels.

The slide 4 is a through slide, i.e. it slides back and forth from an end to the other, and besides, of the guide 4'. The sliding of the through slide 4 is controlled by a hand operated screw through a lever 4". However, it could be produced under an electromechanical or a hydraulic drive.

The cones are in pairs of cones arranged by opposite sides relative to the plane through the axis of revolution of geared motor 1 and the axis of the sliding of the slide 4. As shown in FIG. 2, they can be arranged, for instance, with their axes of revolution all on a same plane. In FIG. 2 numeral 1' indicates a gear directly taking rotary motion from geared motor 1 (see FIG. 1). The cones 2, 2', 2"; 2*a*, 2*a*', 2*a*" are assembled to be integral with respective gearwheels G2, G2', G2"; G2*a*, G2*a*', G2*a*"; G2 and G2*a* being meshed with gear 1', and G2", and G2*a*" respectively being meshed with G2' and G2*a*' which are respectively meshed with G2' and G2*a*', which in turn are respectively meshed with G2 and G2*a*.

One or more means are provided on the slide 4 for mounting roller bearing mandrels, such as roller bearing mandrel 5. Such means can be for instance in the number of two, by opposite sides relative to the input 1' of the geared motor in case C when the slide 4 is centered on input 1' itself. Such means can be conceived to mount a mandrel out of the axis of the displacement of slide 4, like shown in FIG. 2 with reference to the means 5", with four holes fit for mounting a roller bearing mandrel 5' eccentrically on it. But they can also be in a greater number, like three as depicted in FIG. 2, where a further roller 5*a* is shown intermediate means 5 and 5".

The roller mounted on one of the mandrels is intended to cooperate with two of the above rollers, i.e. mounted on the above mentioned cones, to form the triad of rollers necessary for the ring bending. The cones whereupon the other two rollers of the triad are to be mounted can be selected among those which rotate in the same sense. For instance, possible pairs of cones for the mounting of rollers intended to cooperate with a roller mounted on mandrel 5 or 5' are 2–2*a*, 2'–2*a*', 2"–2*a*" and 2"–2*a*, taking the senses of revolution into account.

As shown in FIG. 2, pivoting means 3" are cantileverly supported by the case C for pivotingly supporting and arm having adjustable length 3"*c* in turn pivotingly supporting 3"*a* another arm 3' by an end of the latter, the other end of the same being pivotedly supported by another pivoting means 3"*b* cantileverly supported by case C, which arm 3' bears an adjustable pressure counter-roller 3'*a*, useful for particular working situations. A pipe P to be bent so can be made to pass, for instance, between rollers mounted on 2*a*, 2*a*', and rollers 5*a* and 3'*a*, to realize a "U" bend as depicted in FIG. 2.

Figure 3:
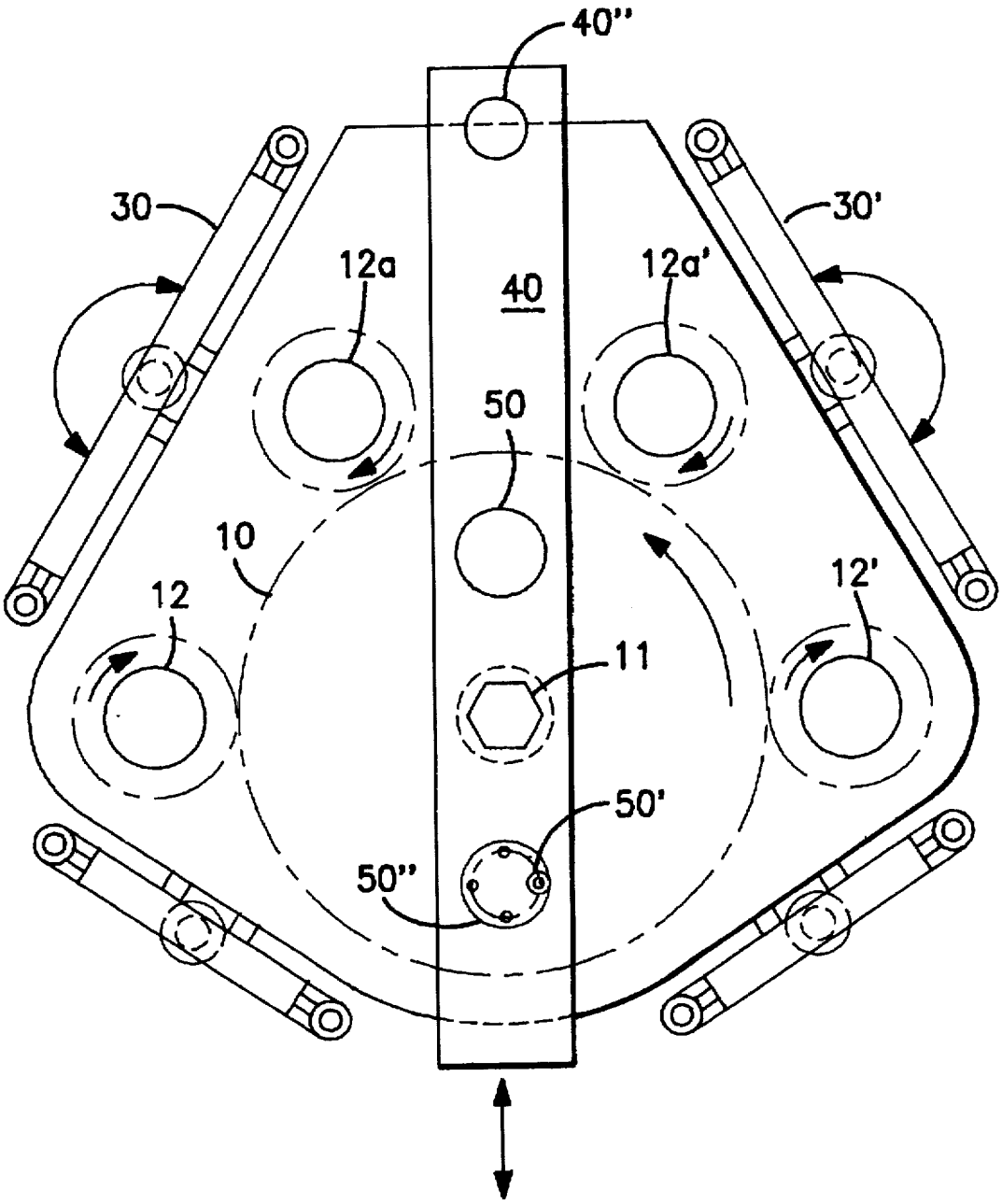
FIG. 3 is a top view of a bending head of a ring bender according to another embodiment of the present invention.

According to the embodiment of FIG. 3, pairs are provided of driving rollers not in line, as in the preceding embodiment, but staggered along the sliding direction of the slide.

With reference to FIG. 3, the elements corresponding to those of FIG. 2 are indicated with the same reference number increased by 10.

A large diameter gear wheel 10 is meshed on the geared motor 11 to transmit the motion to the cones in pairs 12, 12*a* and 12', 12*a*', which pairs have their rotation axes on parallel planes staggered parallelly to the direction of sliding of the through slide 40.

The through slide 40 is endowed with a hole 40" in which an element for controlling its displacement is engaged.

The roller bearing mandrel 50' is mounted eccentrically on a circular plate 50" that can be fixed with bolts in correspondence with a particular angular position of the mandrel 50', so as to be able to bring the roller that goes to mount itself on it off-center relative to the pair of driving rollers mounted on the cones that are selected for cooperating with it.

One can select different pairs of rollers mounted on the cones for the cooperation with a roller mounted on slide 4 or 40, taking the sense of revolution into account.

Figure 4:
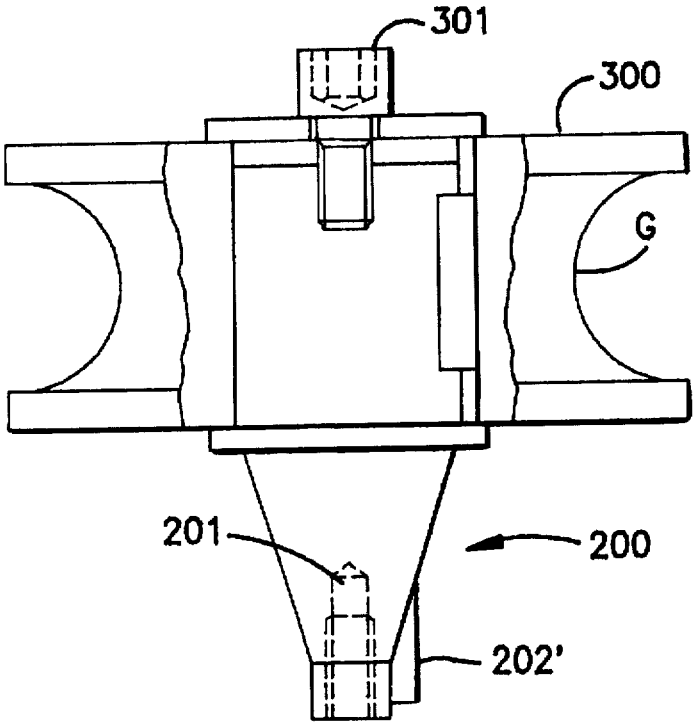
FIG. 4 represents the assembly made up of a roller bearing mandrel with a roller mounted thereupon.
Figure 4A:
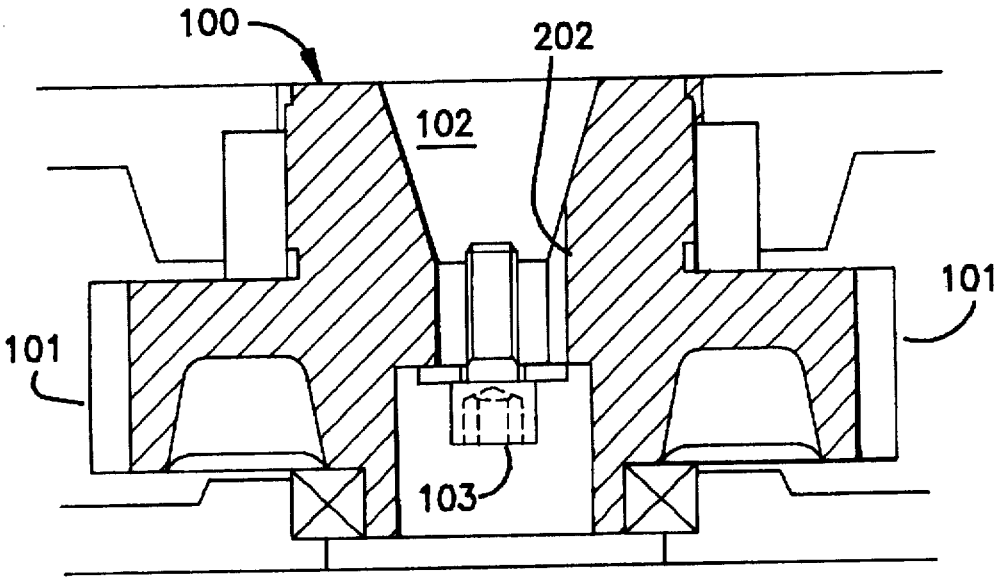
FIG. 4A is a section view of a hollow cone making up a rotary motion drive for roller bearing mandrels, its axis being represented coinciding with the axis of the roller bearing mandrel represented in FIG. 1, in order to illustrate the way of mounting the latter there into.

FIG. 4 and 4A illustrate the aforementioned cones and roller bearing mandrels with a roller being mounted.

The cone 100 takes its motion through a toothing 101. It presents a conical mouth 102 on the bottom whereof the stem projects of a screw 103 fixed in a hole in which the mouth itself inferiorly ends. The head of such screw finds itself and is accessible from the portion of the case opposite the working one, where the concavity of the cone itself opens.

The roller bearing mandrel inferiorly presents a coupling convex cone 200 with a threaded concavity 201 for screwing itself to the screw 103. The coupling cone renders integral itself in rotation to the conical mouth 102 through a key 202' that couples itself with a notch 202 on the surface of the conical mouth 102.

FIG. 4 shows, moreover, a roller 300 mounted by screwing 301 on the roller bearing mandrel.

As can be seen in FIG. 4, it presents a groove G for the bending of pipes. Hollow continuous profiles are to be contemplated different from a groove for kinds of bars not having a circular cross-section.

Mandrels of various sizes can be quickly assembled and disassembled on conical mouth 102, particularly, also mandrels bearing a roller integral thereto, such as are used in the case of the ring bending of small pipes.

Figure 5:
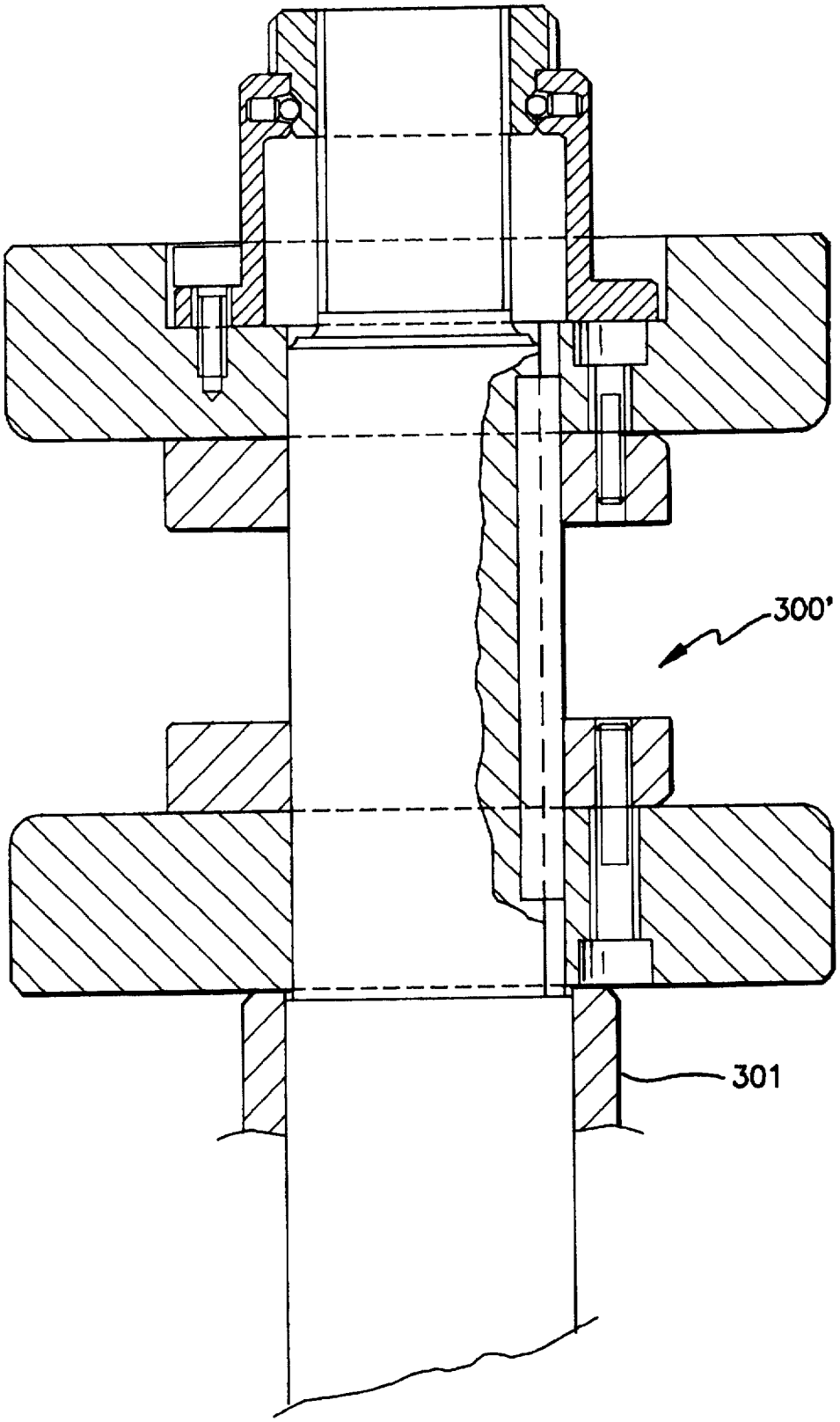
FIG. 5 shows the mounting of a universal roller upon a mandrel cone.

FIG. 5 shows the assembling of a universal roller, i.e. of a roller that offers a section groove, adjustable as a function of the bar or pipe to be ring bent.

FIG. 5 clearly and evidently shows the direct ledge of roller 300' on the cone top 301 having a slight projection on the working table of the machine.

From the preceding disclosure one concludes the following.

The universal ring bender according to the teaching of the present invention has a single electric motor, and turns out to be of not a heavy and of a compact construction.

The slide, being movable and passing from side to side in both senses in the relevant guide, the third roller, i.e. the ring bending, can be on the same side or on the opposite side relative to the operator, which is of a great convenience for the operator itself according to the working situation.

The ring bender has fixed interaxes, whereby it is of the greatest rigidity and of a simple and cheap construction.

The rollers are interchangeable as a function of the size of the pipe or bar to be ring bent, whereby it is no longer necessary to have several ring benders at disposal to operate upon pipes of different sizes. The change of the rollers can take place easily and quickly.

It's possible to have a very large variety of interaxes by virtue of %he possibilities of selection of the positioning of the rollers, a variety which increases with the increase of motion drives and roller bearing mandrels provided on the case and on the through slide respectively.

Therefore, the disclosed machine achieves the objects and affords all the advantages of above.

Moreover, the pairs of mandrel cones left free can be utilized for various workings, such as a flaring operation.

The present invention offers the unique possibility to have with a single machine also the configuration with the third roller off the interaxis between the other two, which is very important to bend for instance aluminum bars.

For instance, to make arcades it is necessary to bend with a single pass, against the pressure of the counter-roller.

In the prior art it was necessary to use several models of ring benders for each configuration of the rollers.

The present invention has been disclosed and depicted with reference to preferred embodiments thereof, but it is to be understood that variations, additions and/or omissions can be made, without so departing from the relevant spirit and protection scope.

For example, the roller bearing mandrels on the through slide 4 or 40 have been disclosed as idling, then only pressure rollers.

However, they could be made two drivers, by connecting them to the geared motor with a Cardan coupling.

Therefore, the present invention is to be considered restricted by the accompanying claims only.

We claim:

1. A ring bender comprising a geared motor;

a box having a working side whereupon rotary motion drives open, taking their motion from said geared motor through gears arranged in the case itself, intended to actuate ring bending rollers respectively mounted thereupon;

a through slide that can be slidingly operated and fixedly in position in a through guide provided in said box, by the same side where said rotary motion drives open, intended to mount a ring bending roller, said rotary motion drives including hollow rotary motion drives provided in pairs, having fixed parallel revolution axes, and then fixed interaxes between one another, intended to receive, interchangeably and integrally in revolution, in their concavity respective roller bearing mandrels and to transmit to the mandrels the rotary motion impressed thereto by said geared motor through the gears arranged in said box;

said through slide transversing the fixed interaxes of said pairs of hollow rotary motion drives, and endowed with at least one means for mounting further roller bearing mandrels.

2. The ring bender according to claim 1, wherein said pairs of rotary motion drives are provided with their axes of rotation being fixed in a same common plane.

3. The universal ring bender according to claim 1, wherein three pairs of rotary motion drives are provided.

4. The universal ring bender according to claim 1, wherein said pairs of rotary motion drives are provided with their rotation axes being fixed on staggered planes.

5. The universal ring bender according to claim 1, wherein two roller bearing mandrels are provided, the one on a side, the other on the other side relative to the input of said geared motor in said box.

6. The universal ring bender according to claim 1, wherein one (5') of the roller bearing mandrels provided on said slide (4) is arranged eccentric on a plate (5") fixable in angular position on the through slide itself.

7. The universal ring bender according to claim 1, wherein at least one roller bearing mandrel on the slide is motored by connection to said geared motor through a Cardan joint.

8. The universal ring bender according to claim 1, wherein said motion drives are each one made up of a mandrel conical shell cone (100) with their concavity projectingly facing on the working side of the box, which takes its motion through a toothing (101) provided on it from said geared motor, and that is endowed with a screwing means (103), accessible from the side of the box opposite the working one, for axially fixing a roller bearing mandrel to it.

9. The universal ring bender according to claim 8, wherein said cones are endowed with an axial groove (202) for their keying with the roller bearing mandrel itself to render it more safely integral to itself in rotation.

10. The universal ring bender according to claim 1, further characterized in that it comprises a means for mounting an adjustable position pressure counter-roller.

* * * * *